United States Patent [19]

Mendenhall

[11] Patent Number: 4,618,063

[45] Date of Patent: Oct. 21, 1986

[54] ADJUSTABLE SHELF PARTITION

[76] Inventor: Walter M. Mendenhall, 512 Lillian Dr., Madeira Beach, Fla. 33738

[21] Appl. No.: 533,805

[22] Filed: Sep. 19, 1983

[51] Int. Cl.[4] ..... A47F 5/00

[52] U.S. Cl. ..... 211/184; 24/453

[58] Field of Search ..... 211/184, 59.4, 191; 24/453; 108/61

[56] References Cited

U.S. PATENT DOCUMENTS

| | | | |
|---|---|---|---|
| 1,900,574 | 3/1933 | Meader | 24/453 |
| 2,110,959 | 3/1938 | Lombard | 24/453 X |
| 2,308,629 | 1/1943 | Rosenberg | 211/184 X |
| 2,909,957 | 10/1959 | Rapata | 24/453 X |
| 3,092,175 | 6/1963 | Suessle | 24/453 X |
| 3,093,027 | 6/1963 | Rapata | 24/453 X |
| 3,494,244 | 2/1970 | Wayland | 24/453 X |
| 3,501,019 | 3/1970 | Armstrong et al. | 211/184 |
| 3,608,741 | 9/1971 | Schray | 211/184 |
| 3,669,278 | 6/1972 | Heroy | 211/184 |
| 3,954,184 | 5/1976 | Mendenhall | 211/184 |
| 4,181,229 | 1/1980 | Moore | 211/184 |
| 4,191,299 | 3/1980 | Moore | 211/184 |

*Primary Examiner*—Robert W. Gibson, Jr.

*Assistant Examiner*—Blair M. Johnson

*Attorney, Agent, or Firm*—Renner, Otto, Boisselle & Lyon

[57] ABSTRACT

A shelf partition for use with a shelf having parallel rows of perforations, each row of perforations including a plurality of perforations which are spaced apart by a predetermined distance. The shelf partition is positionable on the shelf for dividing the shelf into a pair of compartments. The shelf partition comprises a base having a bottom surface adapted to rest on the shelf and a wall portion extending upward from the base. The base has at least one longitudinally extending slot therein. The length of the longitudinal slot in said base is greater than the spacing between adjacent rows of perforations in the shelf and is greater than the spacing between adjacent perforations in each of the rows. Fastening means are movable longitudinally in the slot and are adapted to couple the base to a perforation at any point along the longitudinal length of the slot, thereby allowing adjustment of the orientation of the partition relative to a shelf and adjustment of the position at which the fastening means couples the partition to a perforation.

6 Claims, 9 Drawing Figures

ADJUSTABLE SHELF PARTITION

BACKGROUND OF THE INVENTION

The present invention relates to a partition for separating parts of a display shelf or the like into distinct compartments. The invention relates particularly to a partition with adjustable locking means for securing the partition to various types of display shelves, and in various orientations on the display shelves.

A known type of shelf partition is shown in U.S. Pat. No. 3,954,184. The partition is designed for shelves which have a plurality of parallel rows of perforations, each row being spaced from an adjacent row by a predetermined amount, and each row having perforations which are spaced apart by a predetermined amount. The perforations are engaged by locking pins on the partition to secure the partition to the shelf.

The partition of U.S. Pat. No. 3,954,184 is an integral member, preferably formed of plastic (e.g., polyurethane). It includes a base that rests on a shelf, a wall portion that extends upward from the base, and one or more locking pins that are integral with the base. The locking pins resiliently engage individual perforations in the shelf, and secure the partition to the shelf.

As an alternative to making the locking pins integral with the base, some partitions have annular holes, about the size of the locking pin, formed integrally with the partition base, and the locking pins are designed to extend through the holes and into the perforations in the shelf. Each hole allows a locking pin to move through it to engage a perforation in a shelf, but does not allow lateral shifting of a locking pin therein. The holes are normally spaced apart by a distance corresponding to the difference between perforations on a particular shelf.

Most typical display shelves include rows of perforations to which a partition may be secured. A difference that does exist between many display shelves is the fact that the spacing between the rows of perforations, and between perforations in a particular row, may be different for different types of display shelves. Thus, partitions with integral locking pins (U.S. Pat. No. 3,954,184), and partitions with locking pins that can only move through individual holes, but cannot shift laterally, need to be individually made to fit individual shelves. Specifically, the locking pins for a partition associated with a particular shelf need to be spaced apart by an amount that corresponds to the spacing between perforations in the particular shelf. A partition that is suitable for one shelf would not generally be suitable for a shelf with differently spaced perforations. Thus, a partition for a particular shelf has had to be made to suit the particular geometrical configuraiton of of perforations in the shelf. Moreover, the partition would normally only be useful along a single row of perforations. It would normally not be angularly adjustable relative to the rows of perforations.

SUMMARY OF THE INVENTION

The present invention provides a shelf partition with locking pins that can be adjusted relative to the partition and also relative to the perforations in shelf. The locking pins are adjustable in a manner that allows a single type of shelf partition to be secured to shelves with different spacings between rows of perforations and different spacings between adjacent perforations in each of the rows. With a partition according to the invention, the locking pins can be adjusted along a row of perforations to accommodate different shelves with spacings between perforations in each of the rows. In addition, a partition according to the present invention can be readily disposed at an angle to the rows of perforations. Thus, the invention provides a single form of partition that is quite versatile, in terms of the number of different types of shelves it can be used with, and the different orientations it can be located in on such shelves.

According to the preferred embodiment, the partition has a longitudinally extending base with a wall portion extending upward from the base. The base has at least one longitudinally extending slot, and a locking pin which can slide in that slot, to adjust the position of the locking pin relative to the partition and the shelf perforations. The locking pin has a locking portion with a cross sectional locking dimension that allows it to resiliently engage a perforation in a shelf when it is inserted into a perforation in the shelf. The length of the longitudinal slot is designed to be greater than the normal spacing between adjacent rows of perforations in the partition and greater than the spacing between adjacent perforations in each of the rows. Preferably, each longitudinal slot extends a distance which is at least two times the cross sectional locking dimension of the locking pin that slides in it. Thus, the locking pin has a range of movement in which it can shift longitudinally along its slot, to adjust to different spacings between perforations in a shelf. Moreover, if it is desired to place the partition at an angle relative to the rows of perforations, the ability of the locking pin to slide in its slot allows the partition to be disposed at an angle to the rows of perforations and still allow the locking pin to engage a perforation in another row on the shelf.

Thus, a single form of partition according to the present invention can be disposed in orientations that many existing partitions cannot be placed in, and the single form of partition can also be used with many different types of shelves.

BRIEF DESCRIPTION OF THE DRAWINGS

The further objects and advantages of the present invention will become further apparent from the following detailed description taken with reference to the accompanying drawings wherein.

DETAILED DESCRIPTION OF THE PREFERRED EMBODIMENT

Figure 1:
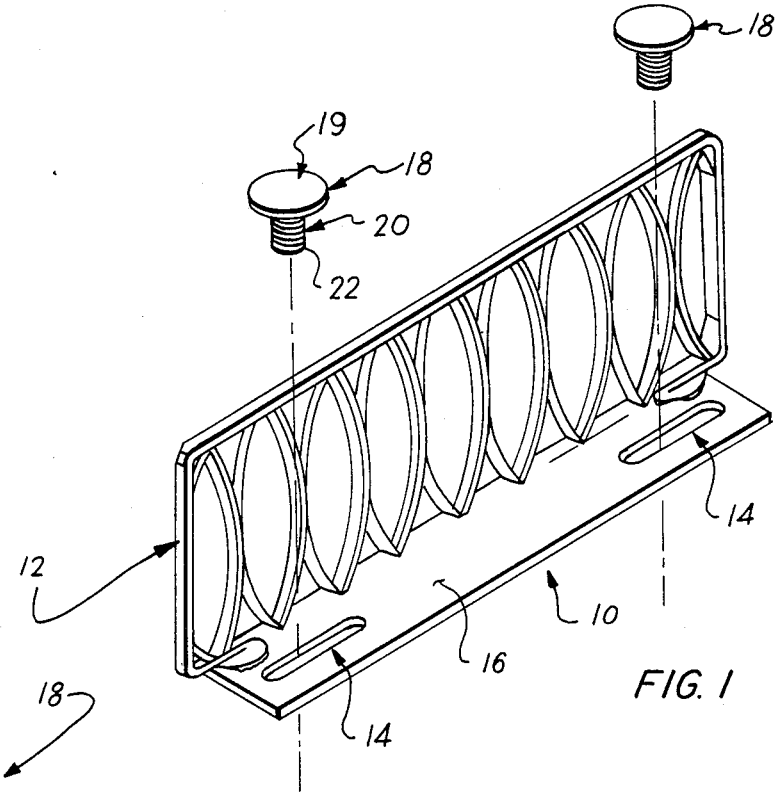
FIG. 1 is a perspective view of a shelf partition embodying the principle of the present invention.

FIG. 1 shows one form of shelf partition embodying the invention. The partition includes a longitudinally extending base 10 which is preferably planar and which is designed to rest on the top surface of a shelf. The partition includes a wall 12 that is integral with the base 10 and which extends upward from the base 10 when the base 10 is resting on a shelf. In FIG. 1, the wall 12 is disposed along one longitudinal side of the base 10. Preferably, the base 10 and the wall 12 are formed as an integral member out of plastic material (e.g., polyurethane), or a plastic manufactured by Phillips Petroleum and sold under the name "K-resin".

The base 10 has a pair of longitudinally extending slots 14 formed integrally therein. The slots 14 are coaxial, and extend completely through the base 10 (i.e., from the top surface 16 of the base 10 to the bottom surface of the base which rests on the shelf).

Figure 3A:
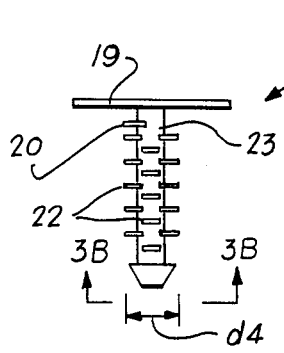
FIG. 3A is a side elevational view of a locking pin for the partition of FIG. 1, taken on an enlarged scale.
Figure 3B:
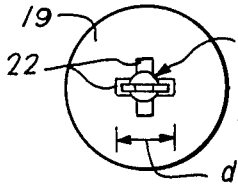
FIG. 3B is a view of the locking pin of FIG. 3A, taken from the direction 3B—3B.

A locking pin 18 is associated with each longitudinally extending slot 14. The preferred type of locking pin is commercially available and shown in FIGS. 1, 3A and 3B. It has an enlarged head 19 that slides along the top surface 16 of the base 10, and a locking portion 20 that (i) depends from the head 19, (ii) extends through the associated slot 14, and (iii) extends outwardly from the bottom of the planar base 10. The locking portion 20 includes a central shaft 23, and a plurality of resiliently flexible fingers 22 that extend outward from the shaft.

Figure 6:
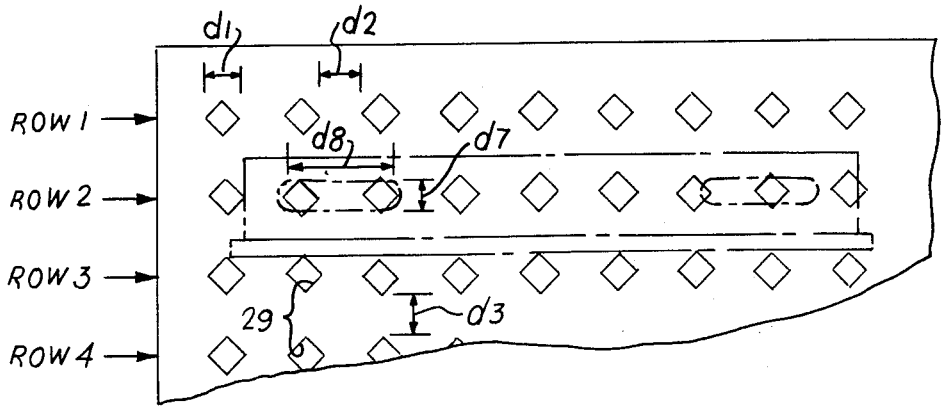
FIG. 6 is a schematic illustration of a shelf with a plurality of rows of perforations, with a different perforation in each row being spaced apart by a certain amount, and illustrating how a partition of the invention is secured to those perforations.

A typical display shelf has a plurality of parallel rows of diamond-shaped perforations 29 (FIG. 6). Each perforation 29 has a maximum opening dimension $d_1$. The rows of perforations are spaced apart by a distance $d_3$, and adjacent perforations in each row are spaced apart by a distance $d_2$. The locking portion 20 of a locking pin 18 is designed to resiliently engage a perforation 29 in a shelf. Specifically, the locking portion 20 has a cross sectional locking dimension (i.e., the distance $d_4$ across the flexible fingers 22 in the locking pin of FIGS. 3A, 3B) that is about equal to or greater than the maximum opening dimension $d_1$ of a perforation 29. Upon insertion of the locking portion 20 of a locking pin 18 into a perforation 29, the fingers 22 can flex to allow the insertion, and then resiliently engage the perforation to secure the locking pin to the perforations.

Figure 4:
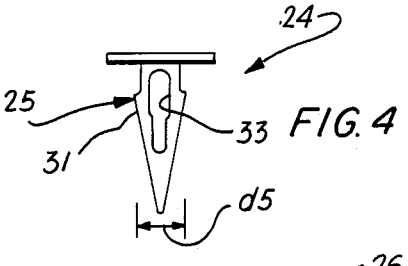
FIG. 4 is a side elevational view, on an enlarged scale, of an alternative form of locking pin for a partition according to the invention.
Figure 5:
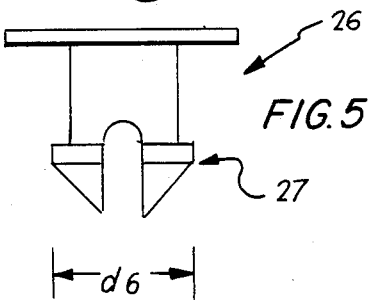
FIG. 5 is a side elevational view, on an enlarged scale, of another form of locking pin for a partition according to the invention.

FIGS. 4 and 5 show alternative locking pins. FIG. 4 shows a commercially available plastic locking pin 24 with a locking portion 25 comprising a wedge-shaped member with a wide central portion 31 with a central opening 33 that makes the central portion 31 resiliently deflectable to allow the locking portion to resiliently engage a perforation in a shelf. The central portion 31 defines the cross-sectional locking dimension $d_5$ for the locking pin 24. FIG. 5 shows a locking pin 26 with a locking action similar to the locking pin of U.S. Pat. No. 3,954,184. The pin 26 has a split finger locking portion 27 with a pair of resilient fingers that define a cross sectional locking dimension $d_6$. As discussed in U.S. Pat. No. 3,954,184, as the resilient fingers are inserted into a perforation, they are initially cammed by the perforation until they clear the underside of the shelf. Then, their resilience biases them to a position in which they align with the underside of the shelf, thus resiliently engaging the locking pin with the shelf.

The slots 14 in the base 10 extend longitudinally. They have parallel side walls 40, and arcuate end walls 42. The width of the slots $d_7$ (FIG. 6), is dimensioned to allow the depending locking portion of a locking pin 18 to slide longitudinally therein, so that a locking pin can slide along a slot. However, the width $d_7$ is less than the diameter of the head 19 of a locking pin, so that the head of a locking pin slides along the top surface 16 of the base 10. Thus, when a locking pin 18 engages a perforation, the head 19 of the locking pin restrains the partition against dislodgment from the shelf.

According to the invention, the locking pins 18 can slide longitudinally in their respective longitudinal slots 14 in the base, and they can lock the partition to a perforation in the shelf at any point along the length(s) of their slot(s). Preferably, the length of each slot 14 (i.e., distance $d_8$ along the parallel side walls 40) is at least two times (and is preferably three times) the cross sectional locking dimension ($d_4$, $d_5$, $d_6$) of the locking portion of the locking pin that slides in the slot. Thus, the locking pin can slide to an extent that is at least two, and preferably three times its cross sectional locking dimension in a respective slot.

Figure 7:
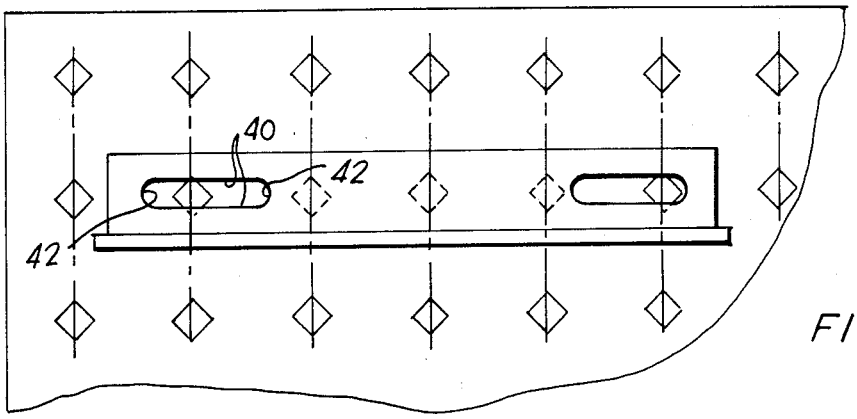
FIG. 7 is a schematic illustration of a shelf in which the perforations have different spacings than in the illustrations in FIG. 6, and illustrating schematically how the same shelf partition can be secured to those perforations.

FIG. 6 shows, in phantom, the outline of a partition similar to that shown in FIG. 1 superimposed on a shelf. The shelf has parallel rows of perforations 29, and the perforations in each row are spaced apart by the same approximate distance $d_3$. Further, the spacing $d_2$ between a pair of perforations is usually at least equal to the cross sectional locking dimension of a locking pin that would engage the perforations. Thus, if the length $d_8$ of a slot extends approximately three times the cross sectional locking dimension of the pin, it can encompass at least two of the perforations. Typically, the spacing between perforations on a shelf may be slightly closer or greater than three times the cross sectional locking dimension of a locking pin but is usually not much more or less than three times the distance. Thus, with two longitudinal slots each extending approximately three times the cross sectional locking dimension of a locking pin, it should be possible to position the longitudinal slots 14 over at least two respective perforations in a shelf row over a wide range of spacings of the perforations in each row. As an example, FIG. 7 shows a partition having the same sized slots as the partition shown in FIG. 6, but on a shelf whose perforations are spaced wider than the shelf of FIG. 6. It can be seen that the slots in the partition still overlie two perforations in a row.

Accordingly, with the invention, the partition can be placed along a row of perforations and the slots in the partition should overlie at least two perforations. Therefore, the locking pins can be aligned with respective perforations and pushed into the respective perforations to lock the partition to the shelf.

Figure 8:
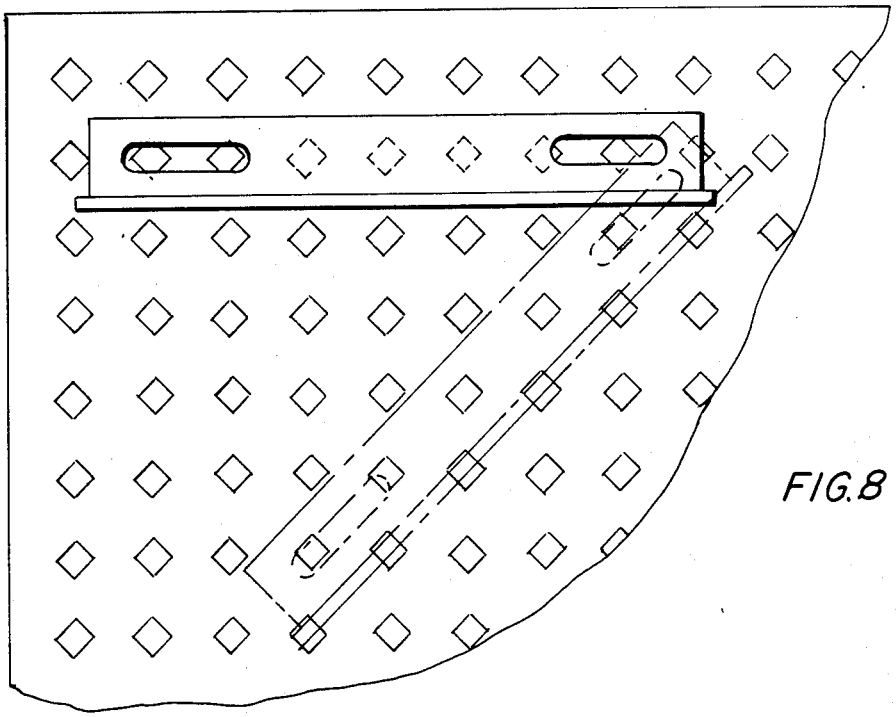
FIG. 8 is a schematic illustration showing how the angular position of the shelf partition can be adjusted relative to the rows of perforations.

In addition, the construction of the invention allows the partition to be angularly disposed on many types of shelves. As shown schematically in FIG. 8, when the shelf partition is pivoted so that it extends at an angle to a row of perforations, its longitudinal slots travel through arcs that should still align them with a perforation in at least two rows of perforations. Thus, the partition can be secured at an angle to the rows perforations.

Figure 2:
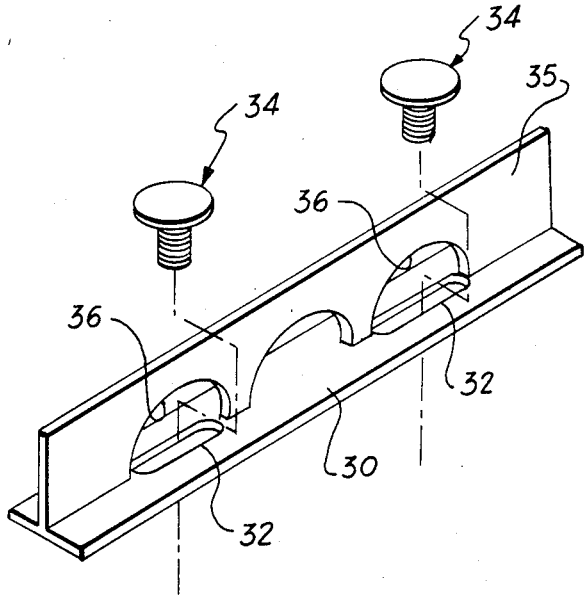
FIG. 2 is a perspective view of another embodiment of a shelf partition embodying the principles of this invention.

An alternative form of the invention is shown in FIG. 2. In FIG. 2 the base 30 of the partition is a longitudinally extending planar member, and the wall 35 extends upward along the center of the base. The coaxial slots 32 are disposed in alignment with the wall 35, and arcuate recesses 36 in the wall 35 provide both ornamental appearance to the partition, as well as providing an opening that allows locking pins 34 access to the longitudinal recesses 32 in the partition. Accordingly, the principles of this invention can be provided both in a partition which is substantially L-shaped (FIG. 1) and also a partition which is substantially centered (FIG. 2).

Thus, it should be possible to lock the shelf partition to various types of shelves whose perforations are spaced apart by different amounts, and whose rows may be spaced apart by different amounts. Further, it should be possible to position the partition in various angular orientations on a shelf.

What is claimed is:

1. A shelf partition for use with a shelf having parallel rows of perforations, each row of perforations including a plurality of perforations which are spaced apart by a predetermined distance, said shelf partition being positionable on said shelf for dividing said shelf into a pair of compartments; said shelf partition comprising an integral patition member consisting essentially of a base having a bottom surface adapted to rest on the shelf, a wall portion extending upward from said base, and a pair of longitudinally extending slots in said base; the length of each of said longitudinally extending slots in said base being greater than the spacing between adjacent rows of perforations in said shelf and being greater than the spacing between adjacent perforations in each of said rows, respective fastening means movable longitudinally in each of said slots and being adapted to couple the base to a perforation at any point along the longitudinal length of its respective slot, thereby allowing adjustment of the orientation of the partition relative to shelf and adjustment of the position at which the fastening means couples the partition to a perforation.

2. A shelf partition as defing in claim 1 wherein the fastening means in each of said longitudinally extending slots comprises a locking pin moveable longitudinally in a respective slot, each locking pin having a locking portion being insertable into a perforation in a shelf, said locking portion being biased to a cross sectional locking dimension which allows it to resiliently engage a perforation in the shelf upon insertion of said locking portion into a perforation, length of each of the longitudinal slots in the base being at least two times the cross sectional locking dimension of the locking pin associated therewith.

3. A shelf partition as defined in claim 2 wherein the base of said partition member is planar, and each of the longitudinally extending slots in the base extends completely through the planar base.

4. A shelf partition as defined in claim 3 wherein said integral partition member is formed of plastic.

5. A shelf partition as defined in claim 2 wherein said wall portion extends along a central portion of said longitudinally extending planar base, said longitudinally extending slots extending along said central portion of said longitudinally extending planar member.

6. A shelf partition as defined in claim 5 wherein said integral partition member is formed of plastic.

* * * * *